United States Patent [19]

Schöler

[11] 3,948,307

[45] Apr. 6, 1976

[54] PLEATER TAPE FOR DRAPES OR CURTAINS OR THE LIKE

[75] Inventor: Alfred Schöler, Wuppertal, Germany

[73] Assignee: Vorwerk & Sohn, Wuppertal-Barmen, Germany

[22] Filed: Dec. 16, 1974

[21] Appl. No.: 532,821

[52] U.S. Cl. ..... 160/348

[51] Int. Cl.[2] ..... A47H 13/14

[58] Field of Search ..... 160/340, 341, 348, 123, 160/126; 223/28–35

[56] References Cited

UNITED STATES PATENTS

| | | | |
|---|---|---|---|
| 2,884,055 | 4/1959 | Schöler | 160/348 |
| 3,559,072 | 7/1951 | Wander | 160/341 |
| 3,741,259 | 6/1973 | Wood et al. | 160/348 |
| 3,774,666 | 11/1973 | Bunger | 160/348 |

FOREIGN PATENTS OR APPLICATIONS

| | | | |
|---|---|---|---|
| 41,850 | 10/1965 | Germany | 160/341 |

*Primary Examiner*—G. V. Larkin

*Attorney, Agent, or Firm*—Holman & Stern

[57] ABSTRACT

A pleater tape which includes at least one pull cord for forming double pleats in drapes, curtains or the like is disclosed. The pull cords are alternately arranged on the back side of the tape and affixed so as to be longitudinally displaceable in the center of a double pleat. The arrangement is such that the lengths of the two oppositely placed single pleats determine the length of the double pleat.

7 Claims, 9 Drawing Figures a
b
c
10
10a
10b
10c
10d
10e
11
12
13
14
14a
14b
14c
15
15a

PLEATER TAPE FOR DRAPES OR CURTAINS OR THE LIKE

BACKGROUND AND SUMMARY OF THE INVENTION

The present invention relates to a pleater tape which includes one or more pull cords for forming double pleats in drapes or curtains or the like, which are alternately freely arranged on the back side of the tape and affixed to the tape. The pull cords are longitudinally displaceably affixed in the center of the double pleat for a short length by means of woven loops or by means of a short changing of the pull cords from the back to the front side of the tape and back again. The lengths of two oppositely placed single pleats determine the length of the double pleat.

In order that the two single pleats which form the double pleat will run smoothly and close to the tape in prior art pleater tape of the described type, the tapes are provided with small worked-in pockets which cover the length of the double pleat, whereby small reinforcing rods with respective measurements and made out of a synthetic material or a similar material, are inserted into said pockets. These types of tapes have the disadvantage that the small reinforcing rods, which run over the longitudinal center of the double pleat, produce an insufficient smoothness of the aforementioned surface of the double pleat and in the handling of the tape tend to fall easily out of the worked-in pockets. Additionally, the insertion of the reinforcing rods is done by hand, with the result that the production costs of the carrier tape are very high with regard to wages, a situation which, in view of mass-production, should be prevented as much as possible.

By the present invention, these disadvantages are avoided, in that means are provided by which the single pleats are fixed so that they run parallel to the longitudinal direction of the tape or are lying flat on the tape. According to the present invention, one of such means includes a small plate made out of a synthetic or similar material which is insertable in a worked-in pocket and which extends over the width and length of the double pleat by which is obtained a large-area stiffening of the tape-section, and whereby the small reinforcing plate at the edges of the sides which glide along the attached pockets at the inner parts of the worked-in pockets, are provided with cuts or notches which are arranged in such a manner that the reinforcing plates are solidly hooked into the threads of the tapeweaving when one tries to pull them out. While in the utilization of these small synthetic plates, one of the above-mentioned disadvantages is not removed, namely, the manual insertion of the small synthetic plates after the tape has been manufactured. The hereinbelow-mentioned means according to the present invention will fully provide a solution.

Accordingly, the double pleats which are formed by the single pleats are placed into a position which is parallel to the longitudinal direction of the drapery, by that part of the tape which forms the length of the double pleat which is reinforced by either a tighter weaving or another type of the binding.

In place of the above-mentioned two means which effect a reinforcing or stiffening of that section of the tape which forms the length of the double pleat, there may be utilized in accordance with the present invention a further means for solving the given problem. A further pull-cord is arranged along the upper edge of the tape in place of the stiffening. This pull cord is tied or secured over the length of the double pleat and over the tape-section between two adjoining double pleats in a longitudinally adjustable manner, and runs therebetween freely over the tape. This additional pull cord is put in operation after the pull cord or the pull cords are pulled for the purpose of forming the double pleat, with the result that the ends of the two single pleats which form the double pleat are tightly pulled to the tape and are there fixed.

For forming multiple pleats, the present invention proposes one each further single pleat at both sides of the double pleat, whereby at their pleat fold-lines which protrude inwardly during the forming of the pleat, the two pull-cords which are arranged on the tape, namely, those pull cords which serve to form the pleats, are affixed thereon displaceably for a short stretch while the pull cord which is arranged along the tape edge, namely, that pull cord which draws in the single pleats to the tape, is displaceably affixed onto its pleat fold-lines which spring outwards.

BRIEF DESCRIPTION OF THE DRAWINGS

The present invention is explained in greater detail by the following description and by means of the accompanying drawings which illustrate the embodiments and in which.

DESCRIPTION OF THE PREFERRED EMBODIMENTS

Figures 1, 2, 3, 4, 5, 6:
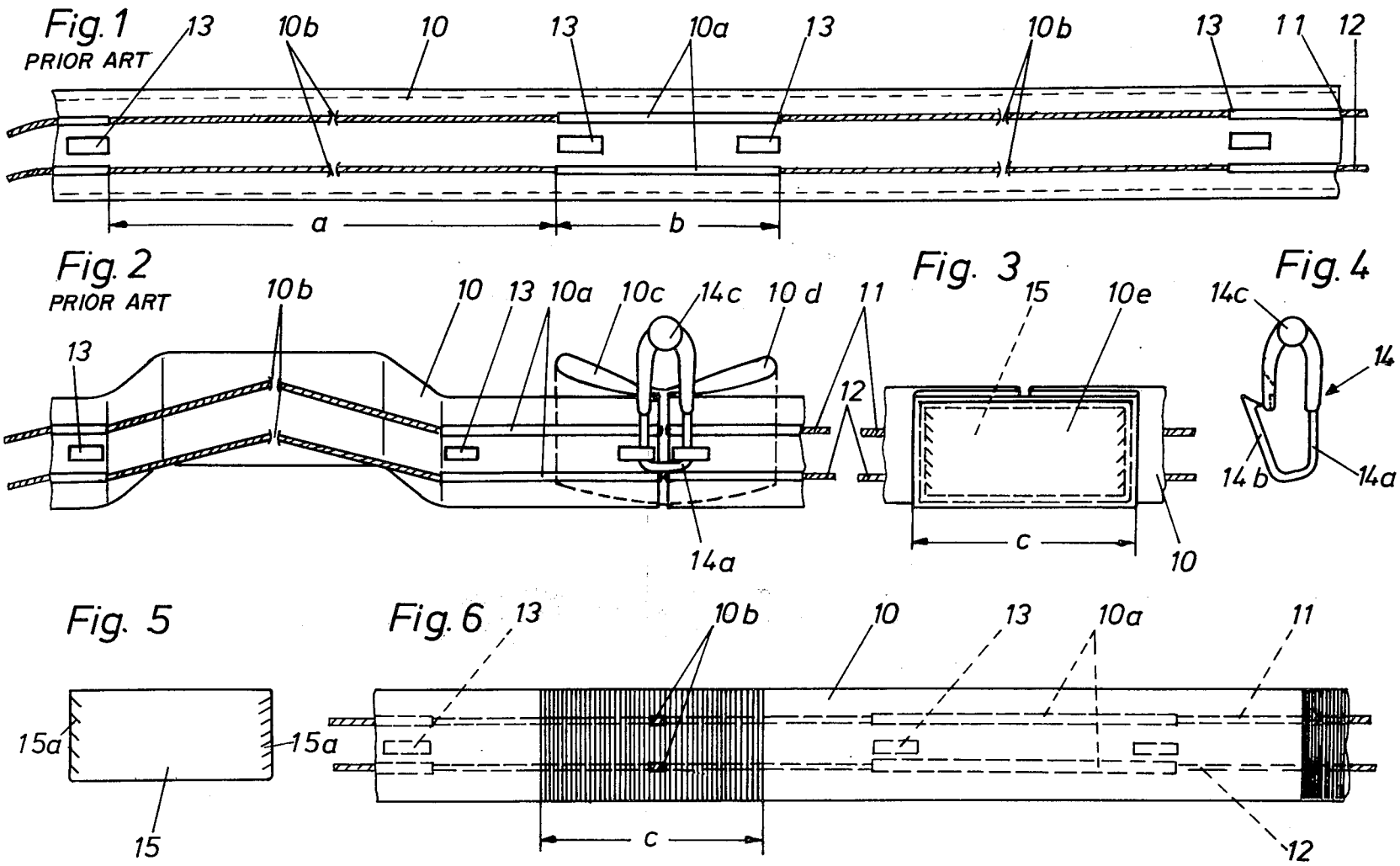
Fig. 1 PRIOR ART
Fig. 2 PRIOR ART
FIG. 1 shows the reverse side of a prior art pleater tape without a reinforcement of the double pleats.
FIG. 2 shows the same tape in the stage of forming the pleat and with a completed double pleat having a roll-hanger affixed thereto.
FIG. 3 shows a double pleat according to the present invention in front view with a worked-in pocket and a reinforcing plate inserted therein.
FIG. 4 shows a hanger in accordance with FIG. 2 with an open U-shaped side.
FIG. 5 shows a reinforcing plate with slits cut in along the two sides.
FIG. 6 shows a section of the tape of the present invention in which the tape section which forms the length of the double pleat is reinforced by a tight weaving.

In the unpleated tape 10 as illustrated in FIG. 1, showing the reverse side of the tape, two pull cords 11 and 12 are worked into the tape in a manner so that they run floatingly, i.e., freely, over the entire length *a* of a double pleat, and over a section *b*, the tape section between two adjacent double pleats, in a separate weave-loop 10*a* in an adjustable manner. In the center of section *a*, the pull cords 11 and 12 are displaceably affixed to the tape by passing the cords through a pair of slits cut in the tape very close together. The affixing of the cords to the tape may also be made by means of a short weaving-loop. At the beginning and after the end of each tape section *a* are worked-in loops 13 into which hanger means are hooked after the completion of the pleating of the tape, as shown in FIG. 2.

The tape 10 is fastened to the upper edge of a curtain or piece of drapery (not shown) in a flat condition as shown in FIG. 1, by sewing the tape along the two broken lines. If one pulls the two pull cords 11 and 12, a double pleat results which comprises two individual pleats 10*c* and 10*d*. The elastic U-shaped curved piece 14*a* of hanger 14, which hanger may be made of a synthetic material, is pulled through the two loops 13, which are pushed together, in order to secure the double pleat. Thereafter one end 14*b* of the hanger 14 which is provided with a hook, as shown in FIG. 4, is hooked into the upper section of the hanger by pressing against the curved piece 14*a* from the bottom. The upper part of the hanger 14 carries a roller means 14*c* which allows the gliding of the draperies in a respective glide-rod (not shown). The function of the described hanger may of course be exercised by means of any other similarly constructed type of hanger.

As shown in the right section of FIG. 2, the two single pleats 10*c* and 10*d* stand outwards and away from the tape 10, which is not considered aesthetic in appearance. FIG. 3 shows how the outward-standing single pleats can inventively be smoothed out and placed in a position which is parallel to the tape by means of inserting a small reinforcing plate 15 into a worked-in pocket which extends over approximately the entire area of a double pleat. The small reinforcing plate 15 (see also FIG. 5) is inserted into the pocket 10*l* without any difficulty, but it is difficult to remove the same since it is provided with cuts 15*a* along the insertedges. These cuts 15*a* are made on an upward angle, which causes a clawing or catching of the small insert-plates between the cuts 15*a* with woven fabric of the pocket 10*e*, so that the small plates 15 cannot fall out of the pockets during the handling of the completed tape. In place of the cuts 15*a*, the identical effect can also be obtained with accordingly arranged notches. The small plates 15 do not present any difficulty during the cleaning or washing of the drapes or curtains, during which they are allowed to remain in their pockets.

A simpler method of stiffening the desired tape section without the costly insertion of reinforcing plates can be obtained wherein the section *c* of the tape 10 which forms the double pleat is reinforced by a tighter type of weaving or a different type of binding. This is shown in FIG. 6 by a hatching of the tape section in question.

Figure 7:
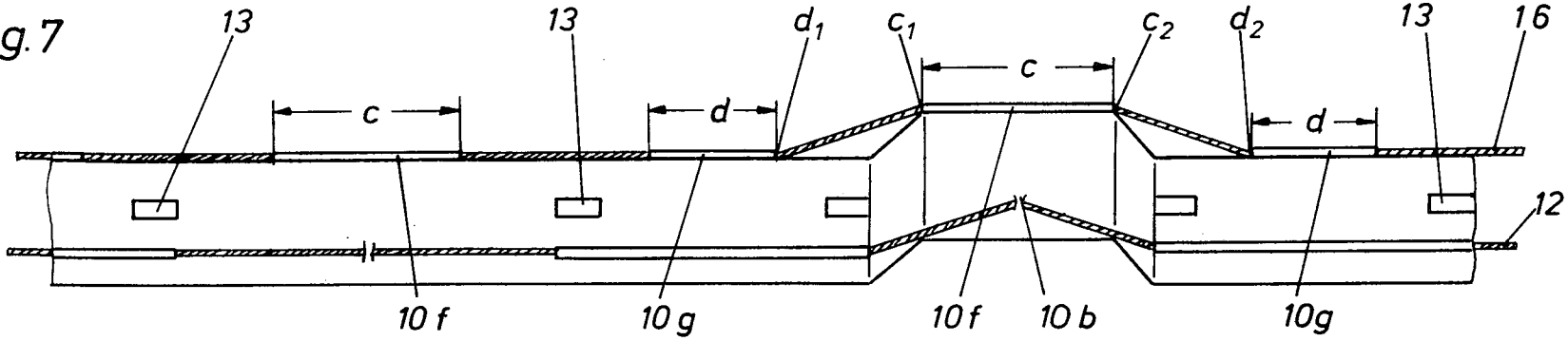
FIG. 7 shows the reverse side of the pleater tape having only one pull cord and one pleat-fixing cord.

Means other than reinforcement can be used to obtain a smooth placing of the single pleat along the tape. In FIG. 7, a further pull cord 16, worked in at the upper edge of the back side of a tape is shown and in contrast to the pleat-forming cord 12, is arranged in a different rhythm of tying and free-moving. Namely, the pull cord 16 runs over the length *c* of the double pleat in a longitudinally adjustable or movable manner in a woven tubing 10*f* and over the tape section *d*, between two adjacent double pleats, longitudinally displaceable in a woven tubing 10*g*. Between the tape sections mentioned above, the pull cord 16 runs freely over the tape 10. In this embodiment, a single pull cord 12 is sufficient for the forming of a double pleat. If one operates the pull cord 12, a double pleat is formed, as already described in the above cases. If one thereafter pulls the pull cord 16, the end $c_1$ of the woven tubing 10*f* is pulled towards the end $d_1$ of the woven tubing 10*g*, and the end $c_2$ of the woven tubing 10*f* is pulled towards the end $d_2$ of the woven tubing 10*g* as a result of which the double pleat is fixed over its length *c* to lie smoothly on the tape.

Figure 8:
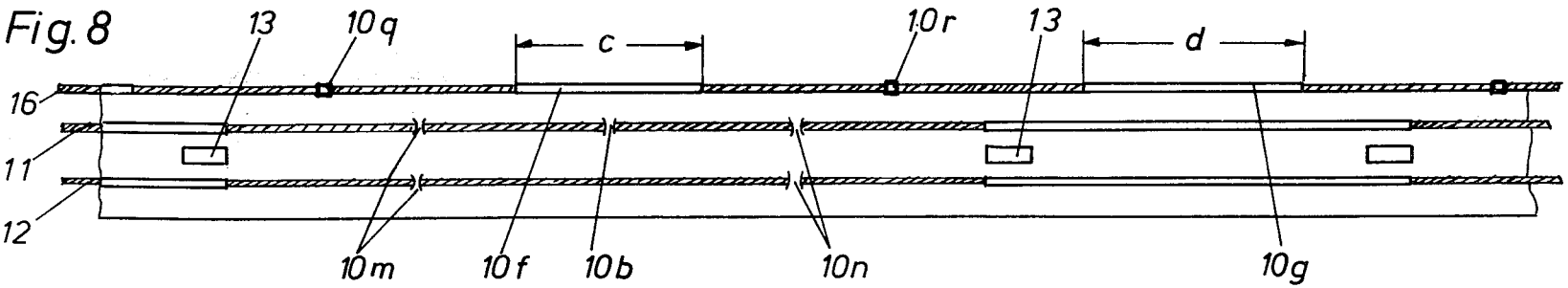
FIG. 8 shows a section of the tape on its reverse side, with two pull cords for forming multi-pleats and a cord for fixing said pleats.
Figure 9:
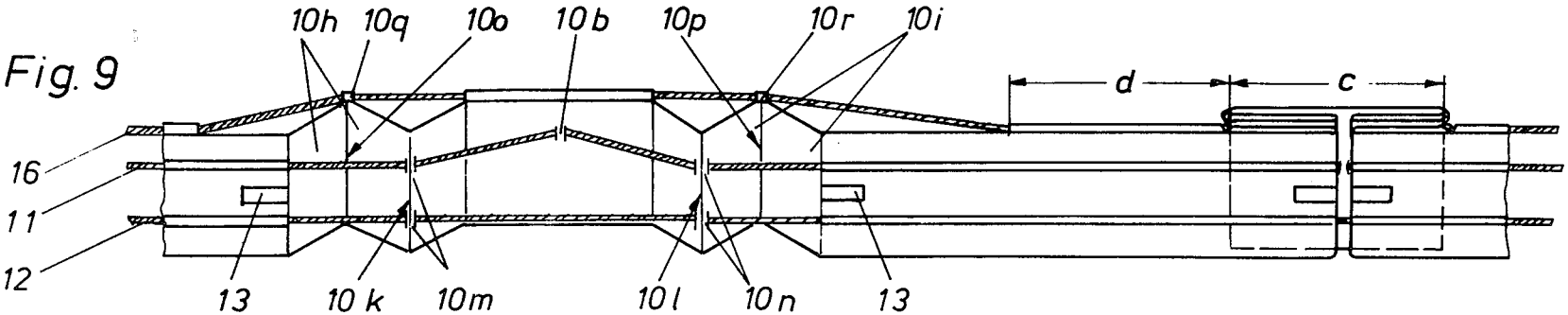
FIG. 9 shows the same tape in the stage of forming the pleat and with a completed multi-pleat.

For the purpose of forming a multitude of pleats, further single pleats 10*h* and 10*i* are proposed at both sides of the double pleat, as shown in FIG. 9. In this embodiment, the pull cords 11 and 12, which serve for the forming of the multiple pleat, are displaceably affixed to the inwardly pointing fold-lines 10*k* and 10*l* of the tape 10, over a short length 10*m* and 10*n* of the tape during the forming of the pleat, and the pull cord 16, which serves for the fixing of the multi-pleat, is adjustably affixed onto the outward pointing fold-lines 10*o* and 10*p* of tape 10 over a short length 10*q* and 10*r* during the forming of the pleat. A multi-pleat is thus formed as seen in the right section of FIG. 9. The multi-pleat comprises two overlapping single pleats. This multi-pleat is often preferred since, even though it requires a larger amount of drapery fabrics, the gathering of a relatively large amount of fabric on a comparatively short section of drapery produces a tight series of voluminous pleats, which transmit an aesthetically pleasing effect. It should hereby be noted that the pull cord 12 in FIGS. 8 and 9 is not, like the pull cord 11, tied displaceably in the center of the double pleat, which results in producing a pleat in the drapes which falls loosely downward. The forming of the multi-pleat, as is the case with the double pleat, is guaranteed according to FIG. 7, with the affixing of only one pull cord.

In general, the present invention is not limited to the embodiments shown in the drawings, nor is the invention limited with regard to the measurements and proportions as shown in the illustrated embodiments.

What is claimed is:

1. A pleater tape for forming multiple pleats in drapes and curtains, said multiple pleats having a center and being formed by at least two oppositely placed single pleats each having a width and a center, comprising:

a tape having a front side, a reverse side and an upper edge;

at least one pull cord affixed to said reverse side at certain points and running freely therebetween;

affixing means for displaceably affixing said at least one pull cord to said reverse side, said affixing means being arranged at said center of said multiple pleats;

a pocket in said tape extending in one dimension through the height of said tape and in the other dimension across one half of the width of the two single pleats forming the multiple pleat; and a plate of synthetic material of the same size having side edges, said plate being disposed within said pocket.

2. The pleater tape according to claim 1, wherein the plate is provided with slits or notches along the side-edges.

3. The pleater tape of claim 1 wherein said affixing means comprises loops worked into the tape.

4. The pleater tape of claim 1 wherein said affixing means comprises a pair of slits in said tape; said at least one pull cord passing through one slit to the front side of the tape and returning to said reverse side through the other slit.

5. A pleater tape for forming multiple pleats in drapes and curtains, said multiple pleats having a center and being formed by at least two oppositely placed single pleats each having a width and a center comprising:

a tape having a front side, a reverse side and an upper edge;

at least one pull cord affixed to said reverse side at certain points and running freely therebetween;

affixing means for displaceably affixing said at least one pull cord to said reverse side, said affixing means being arranged at said center of said multiple pleats; and holding means comprising a denser weaving of the tape extending in one dimension through the height of said tape and in the other dimension across one half of the width of the two single pleats forming the multiple pleat.

6. A pleater tape for forming multiple pleats in drapes and curtains, said multiple pleats having a center and being formed by at least two oppositely placed single pleats each having a width and a center comprising:

a tape having a front side, a reverse side and an upper edge;

at least one pull cord affixed to said reverse side at certain points and running freely therebetween;

affixing means for displaceably affixing said at least one pull cord to said reverse side, said affixing means being arranged at said center of said multiple pleats; and an additional pull cord, said additional pull cord being lontigudinally displaceably affixed along the upper edge of said tape over one half the width of the two single pleats forming the multiple pleat and along such length of tape not desired to be formed into pleats and running freely therebetween.

7. The pleater tape of claim 6, said multiple pleats being formed of more than two oppositely placed single pleats, the more than two single pleats having inwardly pointing and outwardly pointing fold-lines relative to the front side of the tape, wherein said at least one pull cord is displaceably affixed to said inwardly pointing fold-lines and said additional pullcord is displaceably affixed to said outwardly pointing fold-lines.

* * * * *